United States Patent [19]

McLean

[11] 3,937,330

[45] Feb. 10, 1976

[54] UNCOUPLING DEVICE FOR ROTARY COUPLERS ON FREIGHT CARS

[75] Inventor: Leonard A. McLean, Jacksonville, Fla.

[73] Assignee: Seaboard Coast Line Railroad Company, Jacksonville, Fla.

[22] Filed: Aug. 8, 1974

[21] Appl. No.: 496,019

[52] U.S. Cl. ..... 213/166

[51] Int. Cl.[2] ..... B61G 1/08

[58] Field of Search ..... 213/166, 167, 168, 169, 213/170, 219, 211, 159

[56] References Cited

UNITED STATES PATENTS

| | | | |
|---|---|---|---|
| 3,115,973 | 12/1963 | Kulieke | 213/166 |
| 3,572,518 | 12/1968 | Wisler | 213/166 |
| 3,834,553 | 9/1974 | DePenti | 213/166 |

*Primary Examiner*—M. Henson Wood, Jr.
*Assistant Examiner*—Gene A. Church

[57] ABSTRACT

An unlocking device for a rotary coupler on a freight car including a bail rotatably mounted adjacent the open end of the car center sill and adapted to be selectively swung from a rest position to an action position in contact with a rotor element on the locklift assembly linkage of the coupler. An operating rod rotatably mounted on the end of the car is interconnected through a mechanical linkage arrangement to the bail. As this rod is manually turned from the side of the car a mechanical advantage is achieved and force is applied through the bail against the rotor element to cause the knuckle of the coupler to open.

6 Claims, 4 Drawing Figures

UNCOUPLING DEVICE FOR ROTARY COUPLERS ON FREIGHT CARS

BACKGROUND OF THE INVENTION

This invention relates to an improved uncoupling device for use with rotary freight car couplers.

Each freight car used in the United States is required by law to be equipped with an uncoupling means which can be operated from the side of the car without the necessity of trainmen going between the cars. Therefore, cars are equipped with uncoupling levers or rods connected to the coupler and extending to the corners of the cars. By manipulation of the uncoupling lever, rotary action is imparted to the bottom lock lift on the coupler causing the lock to rise and the knuckle to open.

During the last decade, the development of unit trains of rotary dump cars made it desireable to dump cars in a rotary dumper without having to uncouple the cars. This caused the development of the rotary coupler. This type of coupler is connected to the car with a special yoke which permits the coupler to revolve around a longitudinal axis through its center. It permits rotary dumping of a car without also turning over the cars to which it is coupled.

Because of this rotary action, the uncoupling lever cannot be attached to the coupler lest it becomes damaged the first time the couplers are rotated. To solve this problem, early rotary dump cars were equipped with a standard rotary coupler on one end, and a rigid coupler (non-rotary) on the opposite end. Thus, if cars are always oriented together so that a rotary coupler and a rigid coupler are always adjacent to each other, the train can be dumped without uncoupling. Since the standard coupler could have an uncoupling lever attached to it, it is always possible to uncouple the cars with this arrangement.

While the above-described system of orienting cars provides one solution to the way cars may be rotated while coupled together in a train it is apparent that the orientation of car represents an exacting and time consuming task. Thus it would be preferable, in certain situations, if a car is to be used in a unit train, that such car could be equipped with rotary couplers at both ends. This, of course, would eliminate the requirement for proper orientation of car in the train.

It was the above-described objective in mind that thought was also given to the development of an uncoupling lever device which could be used with rotary couplers and could be expected to positively insure the correct uncoupling of a car from both its adjacent cars.

It is known in the art to provide a uncoupling rod device for use with rotary couplers on freight cars in which the manually operated rod device is rotatably mounted with respect to the car body and has a portion which is adapted to be swung into contact with a rotor arm of an unlocking mechanism on the rotary coupler. For a more complete description of known devices attention is directed to U.S. Pat. Nos. 3,572,518, 3,580,400 and 3,115,973.

However, as far as applicant knows, with all previously devised devices that portion of the operating rod which is swung into contact with the rotor arm of the unlocking mechanism moves through an arc to make initial contact at the lower end of the rotor arm. As the rotor arm is swung forward by continued manual movement of the uncoupling device the portion of the device in contact with the rotor arm moves upward on this arm in a manner as seen, for example in FIG. 2 of U.S. Pat. No. 3,572,518. It will be appreciated that as this occurs there is a gradual loss of mechanical advantage which makes it increasing difficult to operate the unlocking mechanism as the coupler reaches its fully unlocked position.

It is therefore an object of this invention to provide an uncoupling rod device for a rotary coupler which permits a portion of the uncoupling rod device to engage the rotor arm at the most advantageous point throughout the full movement of rotor arm. With such an arrangement it is possible to thereby achieve maximum mechanical advantage in movement of this rotor arm.

SUMMARY OF THE INVENTION

In the arrangement according to the invention an operating rod is rotatably mounted to extend along an end of a car and inwardly from a corner of this car to the center sill. At the car corner end of this rod there is a handle portion and adjacent the center sill there is a rod fixed to the operating rod and adapted to be swung in a plane generally parallel to the side face of the center sill as the operating rod is rotated manually from the handle end.

The lower end of the rod fixed to the operating rod is pivotally connected to a plate member that extends forwardly towards the open end of the center sill and in general parallel relationship to the side face of this sill. At its forward end this plate member is pivotally connected to a bail member which hangs downwardly adjacent the open end of the center sill. This bail member is rotatably supported at this point through suitable bearings on opposite side walls of the striker portion of the center sill so that the bail member generally encompasses the open end of the shank portion of the car coupler which extends from this open end. As thus positioned the lower arm member of the bail which extends beneath the shank of the coupler is spaced, when the uncoupling device is not being manually operated, from a rotor element operatively connected to the locklift assembly linkage of the coupler and depending therefrom. The uncoupling device is normally maintained in this position by means of a spring connected between the bail and the center sill.

When it is desired to move the locklift assembly linkage so as to uncouple the car from an adjacent car the handle of the operating rod is turned and this imparts a forward motion to the bail member through the plate member. As the lower arm member of the bail member is moved forward it contacts the rotor element on the locklift assembly linkage and, as the turning motion of the operating arm is continued, the rotor is swung to move the locklift assembly. Movement of this locklift assembly actuates addition internal component parts of the coupler, in a known manner, to unlock the knuckle of the coupler.

The principal on which this improved uncoupling device operates is based on the fact that the rod, which is moved forwardly by a manual turning of the operating rod, moves through a greater arc than the bail member and the lower arm of this bail member that contacts the rotor element. The pivot points of the device are so disposed that the lower arm of the bail contacts the rotor element at the most advantageous point throughout the full travel of the device.

The device, according to the invention has advantages over the known devices. Thus with the same pulling force on the operating handle, an increased force is applied to the rotor element throughout its operating range. This is especially important near the end of the stroke when the action engages the knuckle thrower and causes the relatively heavy knuckle to swivel open.

Further in previously known devices it was required that the handle be connected directly to the rod supporting the rotor contacting bar, through a link near the center sill. Because of the angularity of the two pieces used in the previously known devices, there was a loss of efficiency at the link when made to function. The improved device permits the parts to swivel about points on two parallel lines.

DESCRIPTION OF THE PREFERRED EMBODIMENT

Figure 1:
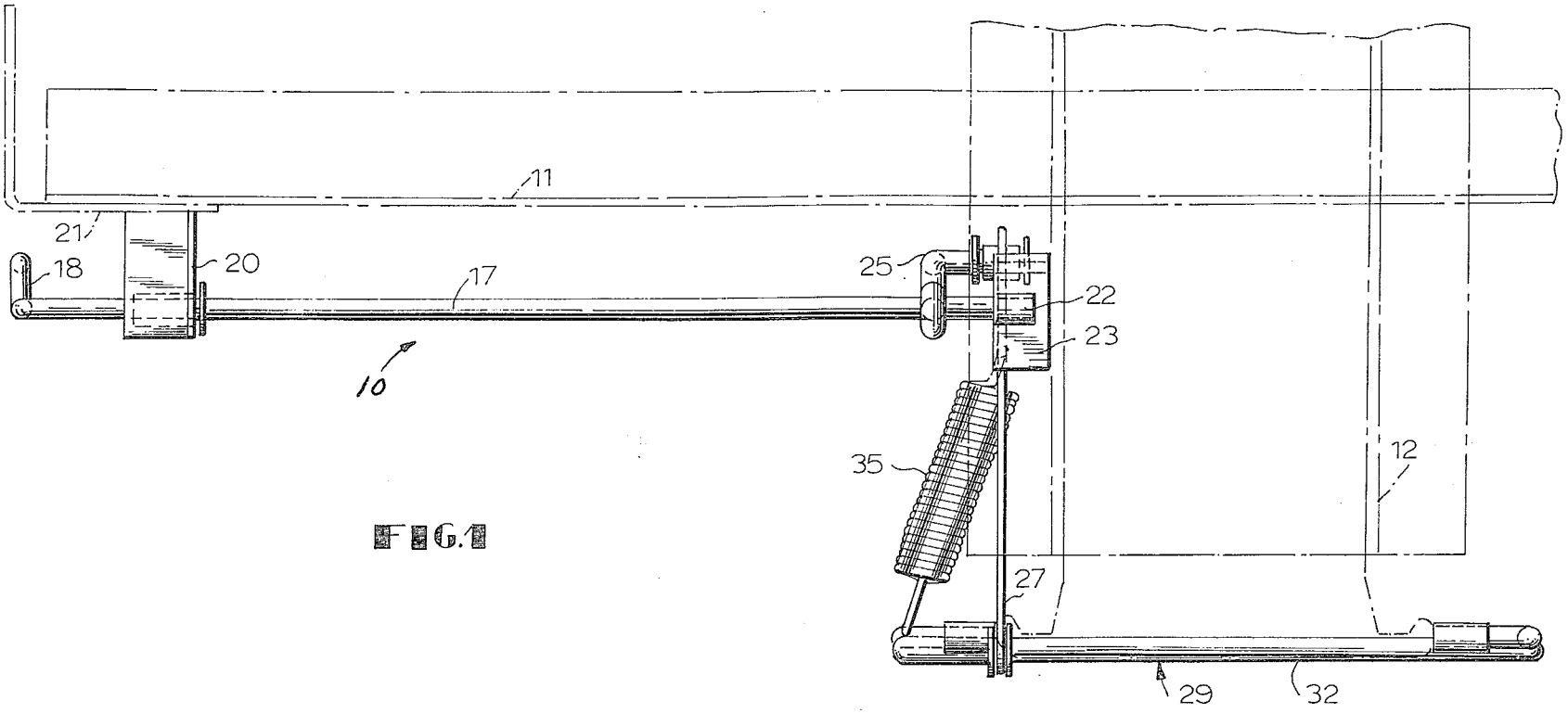
FIG. 1 is a partial top plan view of the end of a freight car showing the uncoupling device in a rest position.

In the Figures of the drawing the uncoupling device is generally indicated at 10. This device is operatively positioned with respect to the end sill 11 of a freight car, not shown in detail, and the center sill 12 of the car. Extending within this center sill 12 is the shank portion 13 of a rotary coupler having a coupler head 14. In a known manner a coupler knuckle is swingably mounted within this head. Also in a known manner a locklift assembly linkage 15 is operatively connected to the coupler knuckle so that when this linkage is turned the knuckle is unlocked.

Dependent from the locklift assembly linkage 15 is a rotor element 16 which is adapted to be swung by a portion of the uncoupling device, in a manner to be described later, so as to actuate the locklift assembly linkage 15 and unlock the coupler knuckle.

The uncoupling device has an operating rod 17 with a handle portion 18. This rod is rotably mounted, adjacent its handle portion by means of a bracket 19 carried on plate 20 which in turn is secured to corner cap 21 of the car. The opposite end of the operating rod 17 is rotatably mounted in another bracket 22 carried on a support plate 23 that is secured to a side face 24 of the center sill 12.

A rod 25 is fixedly secured to the operating rod 17 outwardly from the side face 24 of the center sill and depends downwardly from the operating rod to lie generally parallel to the side face 24. The lower end of this rod 25 is pivotally connected at 26 to a plate member 27 that extends forward below the center sill but generally parallel to the side face 24 thereof, to another pivotally connection 28 with a bail member generally indicated at 29.

Figure 2:
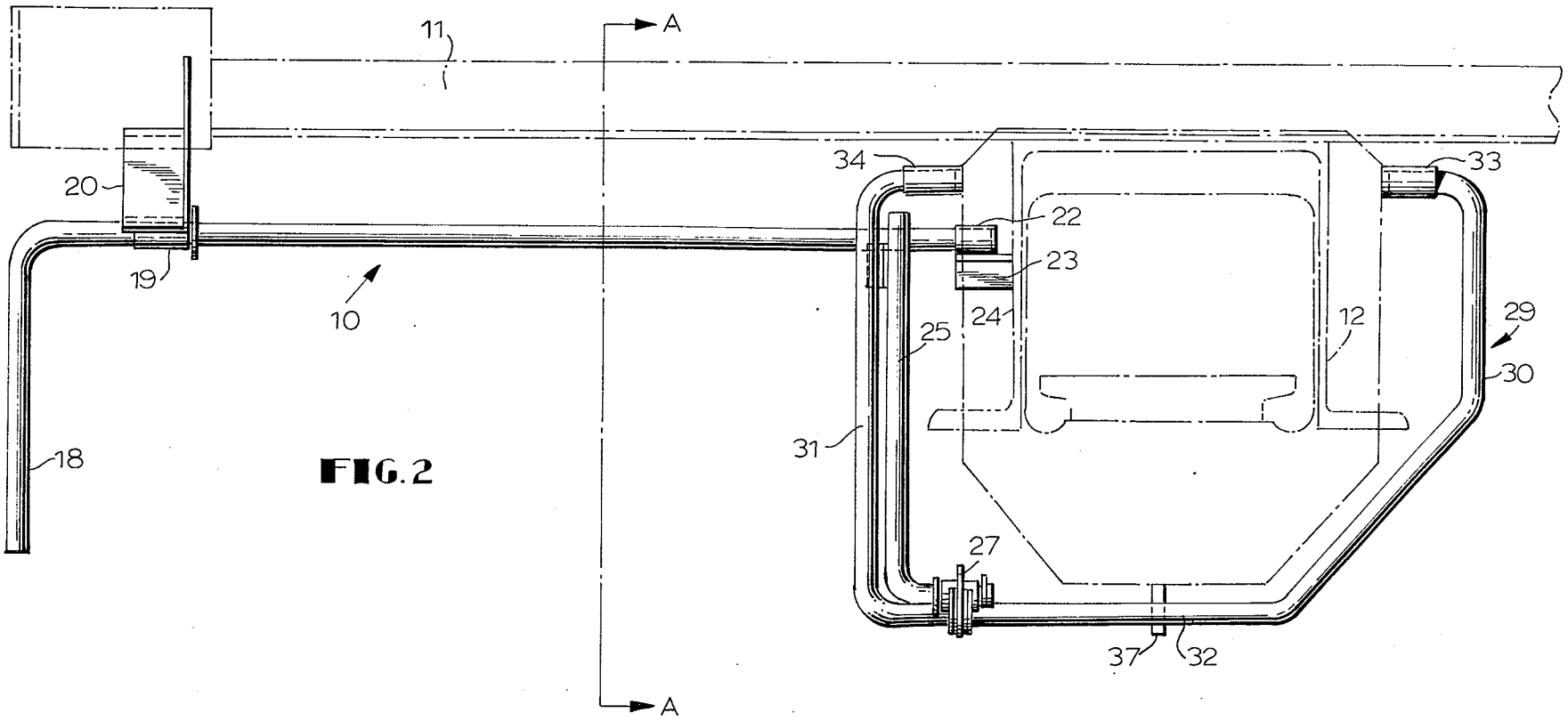
FIG. 2 is a partial elevational view looking toward the end of the freight car of FIG. 1 but, for the sake of clarity, not showing the coupler assembly as disposed in the center sill of the car.
Figure 3:
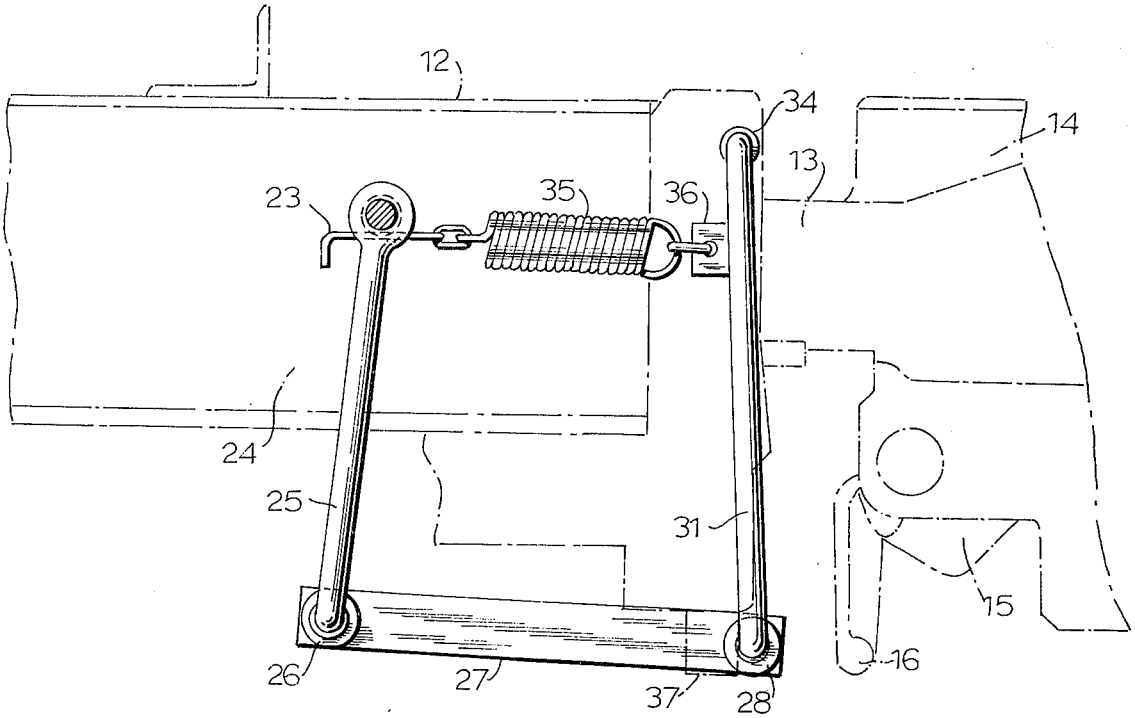
FIG. 3 is a partial side elevational view of the arrangement as looking toward the center sill of the car from the section line A—A, in FIG. 2 and with the uncoupling device in a rest position.

As perhaps best seen in FIG. 2, the bail member 29 has side arms 30 and 31, which lie on opposite sides of the center sill 12, and these side arms are connected by arm portion 32 that lies generally beneath the center sill 12 at the open end thereof. Side arms 30 and 31 have their upper ends inwardly turned towards the center sill 12 to be rotatable received in bearing members 33 and 34, respectively, secured to the end portion of the center sill 12. As thus disposed the bail member 29 in its rest position, as seen in FIG. 3, has arm portion 32 in spaced relationship with the rotor element 16 depending from the locklift assembly linkage 15. The uncoupling device 10 is maintained in this rest position by means of spring 35 extending from bracket arm 36 on side arm 31 to the support plate 23. A stop member 37 is disposed on the end portion at center sill 12 against which arm portion 32 rests when the bail is urged to its rest position by spring 35.

Figure 4:
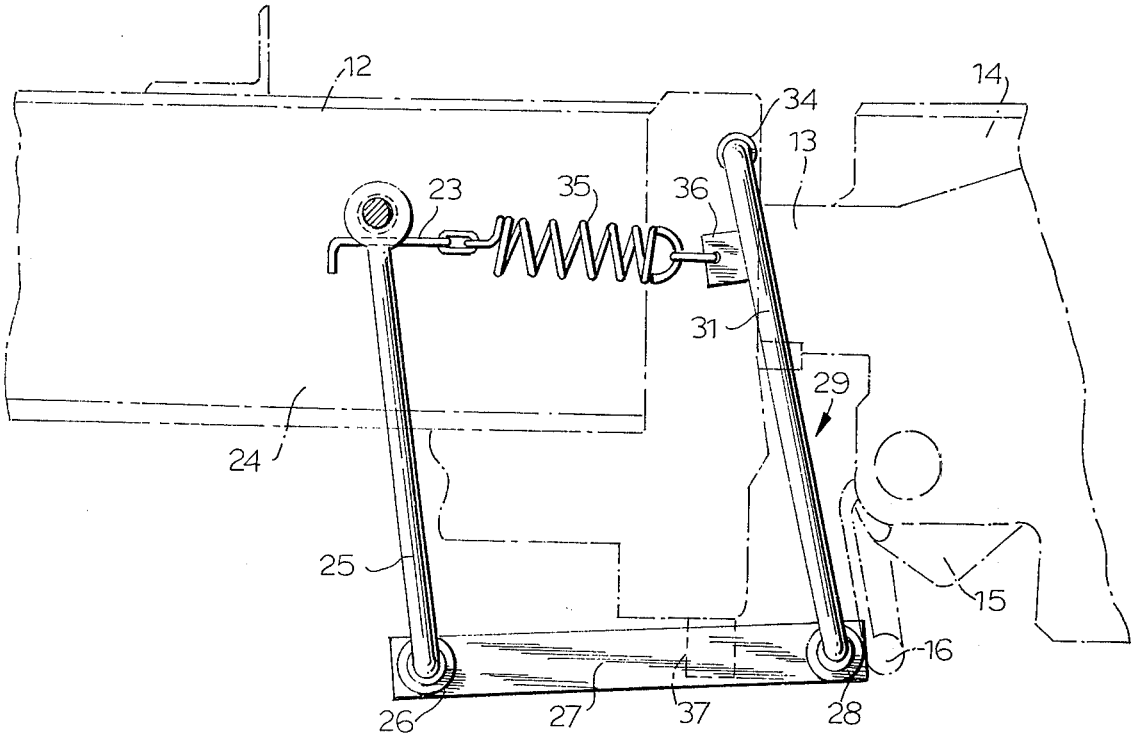
FIG. 4 is a view similar to FIG. 3 but with the uncoupling device moved to a position to contact the rotor of the locklift assembly linkage on the coupler.

The uncoupling device operates in the following described manner. When it is desired to unlock the coupler knuckle the handle portion 18 of the operating rod 17 is manually grasped and swung. This motion is translated, as seen FIG. 4, through rod 25 and plate member 27 to swing the bail member 29 to a position where arm portion 32 contacts rotor element 16. As will be understood the continued movement of the arm portion 32 against the rotor element 16, due to the manual turning of the handle portion 18 of operating rod 17 will result in the rotor element and its associated locklift assembly linkage 15 being forced to a position where the coupler knuckle is unlocked in a known manner.

What is claimed is:

1. In a railway car having a coupler mounted for rotation relative to the car and having a locklift assembly linkage which, when turned, causes the knuckle of the coupler to be unlocked, a rotor element depending from the locklift assembly linkage beneath the head of the coupler, a bail having side arms and a connecting arm portion, the upper ends of the side arms being rotatably received in bearing member on opposite side faces of the center sill of the car and with the connecting arm adjacent the rotor element, the bail being urgable through a manually operated leverage arrangement, to swing from a rest position to a position where the arm portion contacts and turns the rotor element so as to turn the locklift assembly linkage and cause the knuckle to be unlocked, the improvement in the manually operated leverage arrangement which comprises:

A. An operating rod having a handle portion for manual grasping, said operating rod being rotatably mounted between spaced bearings lying adjacent a corner of the car and on said center sill thereof, said operating rod as so mounted extending inwardly from its handle portion at the car corner and lying in a plane between the bail and an end sill of the car; and B. A mechanical linkage intergrally connected at one end to said operating rod and extending generally transversely to the plane of said operating rod and being pivotally connected to said connecting arm portion of said bail at its other end, whereby when said handle portion is manually turned said connecting arm portion of said bail is urged from a rest position into contact with said rotor element and with a force greater than that applied to the handle portion due to the mechanical advantage obtained through the mechanical linkage.

2. An arrangement as in claim 1, wherein said operating rod extends inwardly in a plane generally parallel to the plane of said end sill.

3. An arrangement as in claim 1, wherein said bearing supporting said operating rod on said center sill is disposed in a plane below that of the plane in which said bearing members for supporting said bail on said center sill are disposed.

4. An arrangement as in claim 3, wherein said mechanical linkage includes a rod integrally connected at one end to said operating rod and depending therefrom along an adjacent side face of the center sill said rod being pivotally connected at its lower end to a plate member, at a first portion thereof, said plate member extending generally parallel to the adjacent side face of said center sill and being pivotally connected, at another portion of said plate member, to said connecting arm portion of said bail.

5. An arrangement as defined in claim 4 further comprising a resilient means disposed between at least one of said side arms of said bail and a connecting means on a side face of said center sill, and resilient means retaining said bail in its rest position.

6. An arrangement as defined in claim 5 wherein said resilient means is a coil spring.

* * * * *